United States Patent [19]

Eto et al.

[11] Patent Number: 4,998,114

[45] Date of Patent: Mar. 5, 1991

[54] PORTABLE PARABOLIC ANTENNA APPARATUS

[75] Inventors: Hirohiko Eto, Tokyo; Shigeki Kamiyama, Kawasaki; Haruto Kondo, Yokohama, all of Japan

[73] Assignee: Kabushiki Kaisha Toshiba, Kawasaki, Japan

[21] Appl. No.: 201,855

[22] Filed: Jun. 3, 1988

[30] Foreign Application Priority Data

Jun. 3, 1987 [JP] Japan ..... 62-138167
Apr. 8, 1988 [JP] Japan ..... 63-86612

[51] Int. Cl.[5] ..... H01Q 1/08

[52] U.S. Cl. ..... 343/840; 343/881; 343/882; 343/916

[58] Field of Search ..... 343/878, 880, 881, 882, 343/840, 912, 915, 916, 765

[56] References Cited

U.S. PATENT DOCUMENTS

| | | | |
|---|---|---|---|
| 2,860,342 | 11/1958 | Warnery | 343/881 |
| 3,005,987 | 10/1961 | Mack et al. | 343/915 |
| 3,028,595 | 4/1962 | Cole et al. | 343/882 |
| 3,714,660 | 1/1973 | Scrafford et al. | 343/880 |
| 4,458,251 | 7/1984 | Bondon | 343/916 |
| 4,506,271 | 3/1985 | Gonzalez | 343/915 |
| 4,761,655 | 8/1988 | Butcher | 343/916 |

FOREIGN PATENT DOCUMENTS

| | | | |
|---|---|---|---|
| 38773 | 3/1980 | Japan | 343/915 |
| 55-42420 | 3/1980 | Japan . | |
| 55-112004 | 8/1980 | Japan . | |
| 55-112909 | 8/1980 | Japan . | |
| 57-82704 | 5/1982 | Japan . | |
| 1390628 | 4/1975 | United Kingdom | 343/915 |
| 2150355 | 6/1985 | United Kingdom | 343/912 |
| 2167240 | 5/1986 | United Kingdom | 343/881 |

OTHER PUBLICATIONS

Patent Abstracts of Japan, vol 10, No. 244 (E-430 [2300], 22 Aug. 1986; & JP-A-61075603 (Nippon Hoso Kyokai) 18-04-86.

*Primary Examiner*—Michael C. Wimer
*Attorney, Agent, or Firm*—Oblon, Spivak, McClelland, Maier & Neustadt

[57] ABSTRACT

A portable parabolic antenna apparatus is disclosed, which comprises a leg assembly which includes at least three legs and a foldable support assembly. The support assembly includes a base rotatably and detachably mounted on the leg assembly and supporting a communication device, a foldable intermediate member having one end coupled to the top of the base, and a reflector holding member coupled to the other end of the intermediate member, for holding a parabolic antenna, the reflector holding member being located at such a distance from the base that it support the communication device when the support assembly is unfolded, and when the support assembly is folded, the reflector holding member is moved to contact the base.

22 Claims, 8 Drawing Sheets

PORTABLE PARABOLIC ANTENNA APPARATUS

BACKGROUND OF THE INVENTION

1. Field of the Invention

This invention relates to a parabolic antenna apparatus used as a ground mobile station for carrying out broadcasting and communication by utilizing satellite communication and, more particularly, to a portable parabolic antenna apparatus, which can be readily transported by men and can be readily moved and installed.

2. Description of the Related Art

Various kinds of mobile parabolic antenna apparatus for carrying out broadcasting and communication by utilizing satellite communication are well known in the art. A mobile parabolic antenna apparatus is provided with a parabolic reflector, but a parabolic antenna apparatus having a reflector with a diameter of 2.5 m or above can be very difficult for men to transport. Such a parabolic antenna apparatus, therefore, is designed such that it has a structure to be mounted in a vehicle.

However, there is a need of carrying out reports and communications using a parabolic antenna apparatus even in a place, into which no vehicle can enter. For this reason, there has been a demand for a parabolic antenna apparatus, which can be transported by men even to a place as noted above and can be compactly accommodated.

Meanwhile, a typical mobile parabola antenna apparatus is designed to be mounted in a vehicle, so that it is comparatively heavy in weight and comparatively large in size. Therefore, it can be difficult for men to transport. In such a case when it is intended to transport the parabolic antenna apparatus by disassembling it, its disassembly and reassembly take a long time, so that this is impractical.

Regarding parabolic reflectors for a parabolic antenna apparatus, there are those which can be disassembled into two or more parts. Such a dividable reflector is suited for transport because it can be compactly accommodated by disassembling it into small parts. However, in a typical dividable reflector, when its parts are coupled together by a bolt, a stress is generated in the coupling section due to a stress produced at that time, thus deteriorating the accuracy of the reflection surface.

SUMMARY OF THE INVENTION

An object of the invention is to provide a portable parabolic antenna apparatus, which is comparatively light in weight, can be compactly accommodated and can be comparatively speedily and readily accommodated and reassembled without use of any particular tool.

To attain the above object of the invention, there is provided a portable parabolic antenna apparatus, which comprises a leg assembly having at least three legs and a support assembly including a base rotatably and detachably mounted on the leg assembly and supporting a communication device, a foldable intermediate member having one end coupled to the top of the base, a reflector holding member coupled to the other end of the intermediate member, for holding a parabolic antenna, the member being located at such a distance from the base that it supports the communication device when the support assembly is unfolded, and when the support assembly is folded, the reflector holding member is moved to contact the base. The parabolic antenna apparatus according to the invention further comprises a communication device releasably mounted on the base of the support assembly, and a parabolic reflector detachably mounted on the reflector holding member of the support assembly.

The portable parabolic antenna apparatus according to the invention includes the foldable leg assembly and foldable support assembly, and the leg assembly, support assembly, reflector and primary radiator can be carried and transported independently of one another. Further, when the support assembly is unfolding, the communication device can be supported on the base. Further the primary radiator and communication device are spaced apart by a reduced distance, and their connection is facilitated. Further, performance of the apparatus can be improved.

DETAILED DESCRIPTION OF THE PREFERRED EMBODIMENTS

Now, preferred embodiments of the invention will be described with reference to the accompanying drawings.

Figure 1:
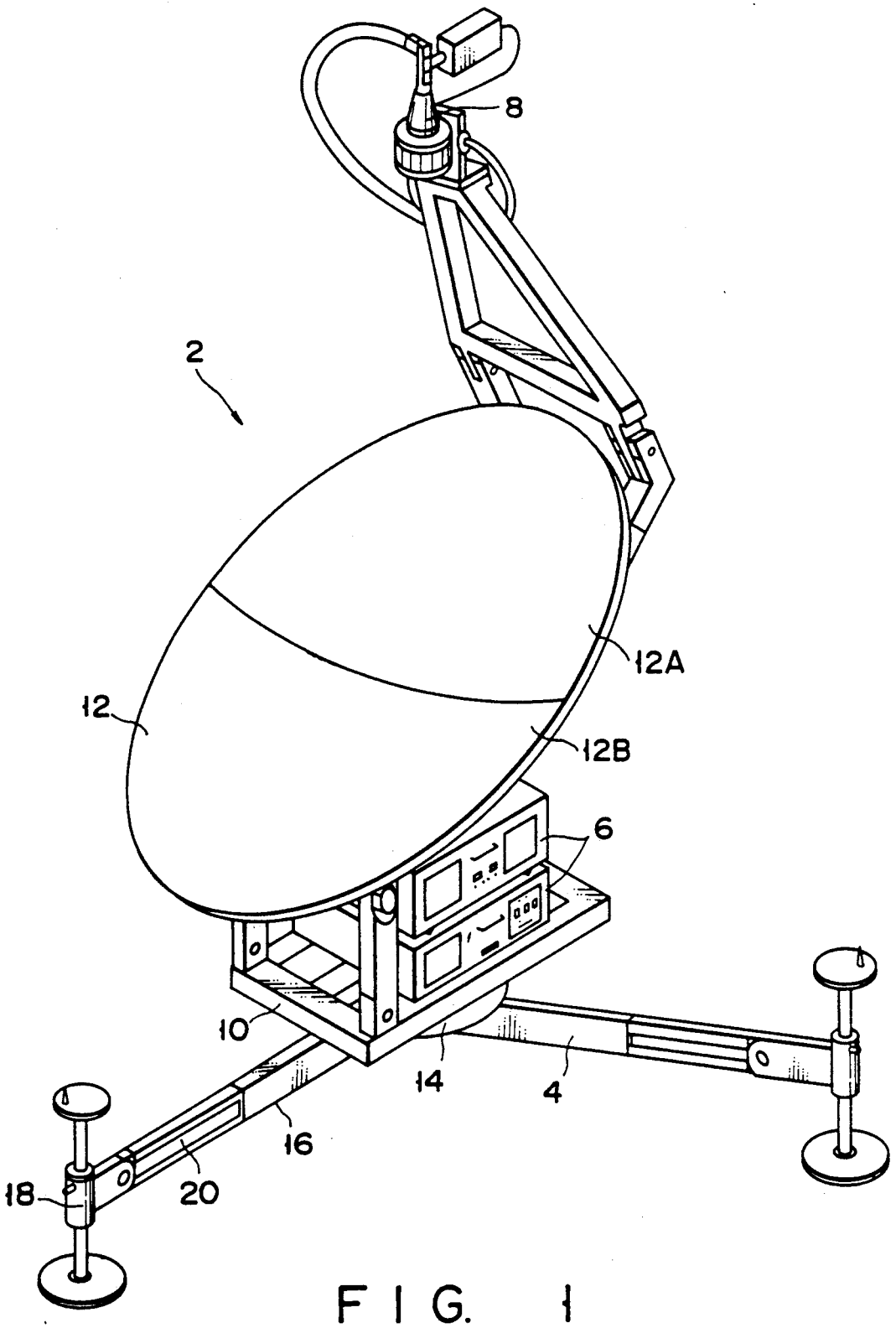
FIG. 1 is a perspective view showing an embodiment of the portable parabolic antenna apparatus according to the invention.

FIG. 1 shows a perspective view of a portable parabolic antenna apparatus according to the invention. Illustrated portable parabolic antenna apparatus 2 comprises a leg assembly, i.e., tripod 4 for installing apparatus 2 on the ground, a reflector support assembly or reflector support 10, and dividable reflector 12. Support assembly 10 includes a base, which is rotatably mounted on tripod 4, said base having communication device 6 mounted or accommodated therein, and an arm, on which primary radiator 8 is mounted. Dividable reflector 12, which consists of a plurality of parts, is secured to the top surface of support assembly 10.

Figure 2:
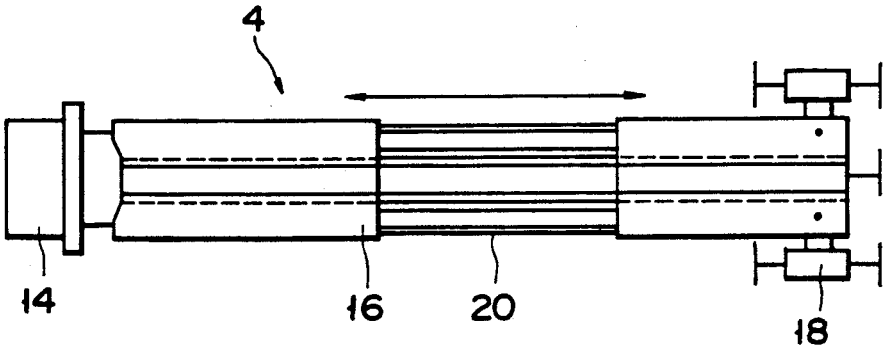
FIG. 2 is a side view showing a leg assembly in a folded state.

As shown in FIG. 2, tripod 4 includes platform 14, three legs 16 and level adjustment jacks 18. Three legs 16 are each rotatably mounted with respect to platform 14, and each jack 18 is rotatably mounted in a free end of each leg 16. When installing antenna apparatus 2 on the ground, legs 16 are spread to be parallel to the ground surface, and jacks 18 are turned to be perpendicular to the ground surface When accommodating tripod 4 as shown in FIG. 2, legs 16 are turned to be parallel to the center line of platform 14, and then jacks 18 are turned to be parallel to the longitudinal direction of legs 16. Legs 16 are each provided with a slide mechanism so that they can be elongated and contracted in the longitudinal direction thereof. By adjusting slide mechanisms 20, legs 16 can be elongated, if necessary, when installing the antenna apparatus and can be contracted to be compactly accommodated when not using the antenna apparatus.

Figure 3:
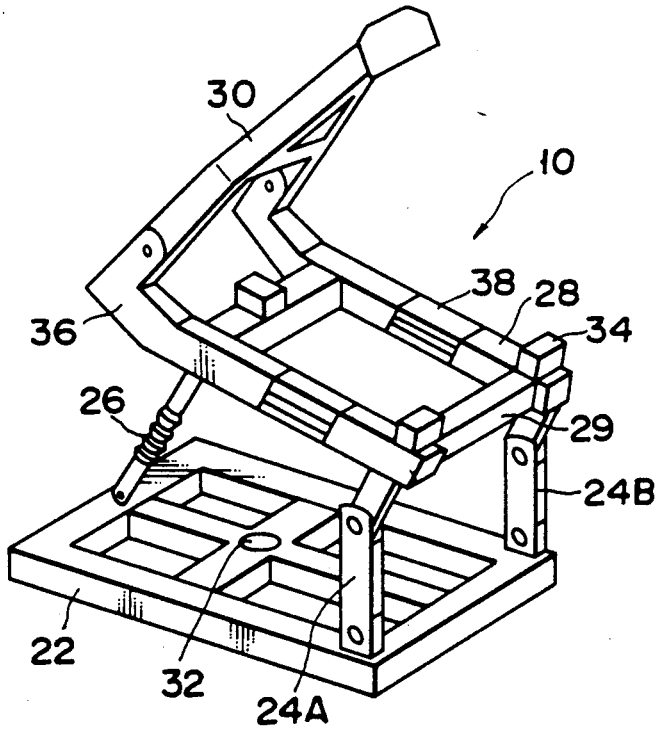
FIG. 3 is a perspective view showing a support assembly in a unfolded state.

Support assembly 10, as shown in FIG. 3, includes base 22. Pair support legs 24A and 24B each have one end rotatably mounted on a top front portion of base 22. Jack 26 has one end rotatably mounted on a top rear portion of base 22 for adjusting the angle of reflector 12. Reflector holder 28, on which reflector 12 is installed, is rotatably mounted on the opposite ends of support legs 24A and 24B and jack 26. Arm 30, on which a primary radiator is to be mounted, is rotatably mounted on a rear portion of holder 28.

Figure 4:
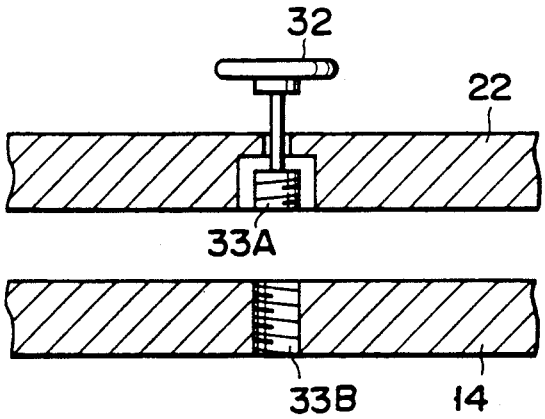
FIGS. 4 and 5 are fragmentary sectional view showing a structure of coupling between a platform of the leg assembly and a base of the support assembly.
Figure 5:
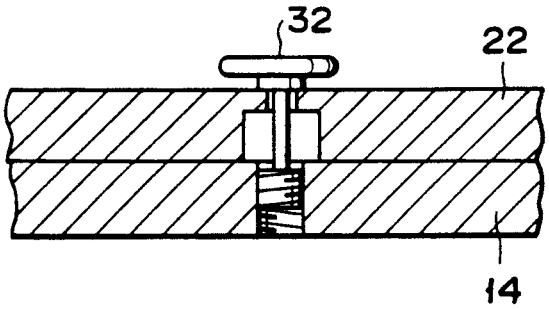

Base 22 of support assembly 10 has a substantially rectangular frame and a cross beam which extends within and is integral with the frame. In a central portion of the cross beam is provided bolt 32 with a handle, bolt 32 having a retainer mechanism as shown in FIGS. 4 and 5. A central portion of platform 14 of tripod 4 is provided with female thread 33B which is engaged with a male thread 33A of bolt 32 with a handle. Base 22 can thus be removably and rotatably mounted by bolt 32 with a handle on platform 14 of tripod 4.

Reflector holder 28 of support assembly 10 has a substantially rectangular frame 29. When support assembly 10 is unfolded, frame 29 is held at a predetermined height and angle with respect to base 22 by support legs 24A and 24B and jack 26. Frame 29 has left and right bars, each of which has slide mechanism 38 so that frame 29 can be elongated and contracted in the longitudinal direction thereof. Three projected portions 34, to which reflector 12 is to be mounted, are further provided at the top of frame 29. A rear portion of frame 29 has a pair of upwardly bent arm supports 36, to which arm 30, for mounting the primary radiator thereon, is rotatably coupled.

Arm 30 for mounting the primary radiator thereon has a triangular frame with a stem thereof being coupled to arm supports 36 of reflector holder 28. Primary radiator 8 is mounted on the free end of arm 30.

Figure 6:
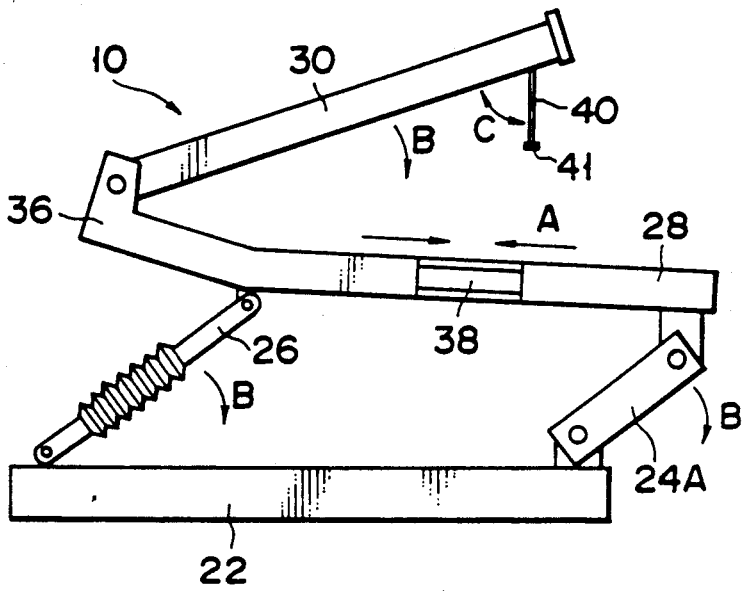
FIGS. 6 and 7 are side views showing a first embodiment of the support assembly.
Figure 7:
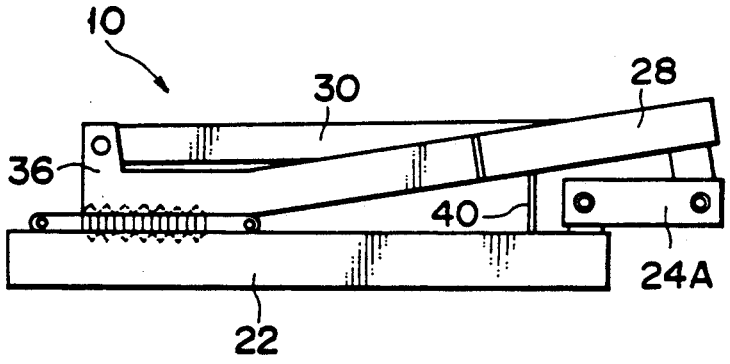

To accommodate support assembly 10 having the above structure, slide mechanisms 38 of mirror holder 28 are first moved in directions of arrows A in FIG. 6 to cause contraction of the frame. Then, support legs 24A and 24B, jack 26, and arm 30 are folded in such a manner as is shown in FIG. 7 by turning them in directions of arrows B in FIG. 6. Thereafter, support assembly 10 may be secured in its folded state by using locking member 40 provided on a central portion of the free end of primary radiator support arm 30. Locking member 40 is rotatably provided for rotation in directions of arrow C in FIG. 6, and has locking tip 41 on an and portion thereof. Locking tip 41 can be engaged with the locking projection of base 22 (not shown). Alternatively, support assembly 10 can be secured in its folded state by using a band.

Figure 8:
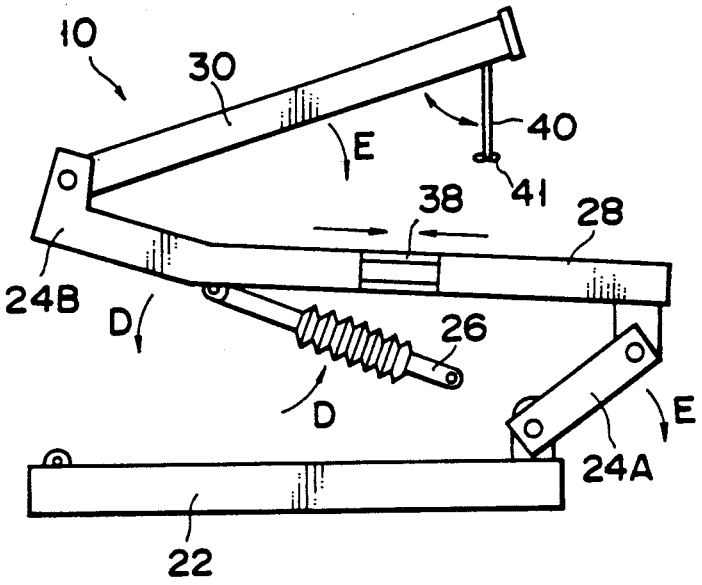
FIGS. 8 and 9 are side views showing a second embodiment of the support assembly.
Figure 9:
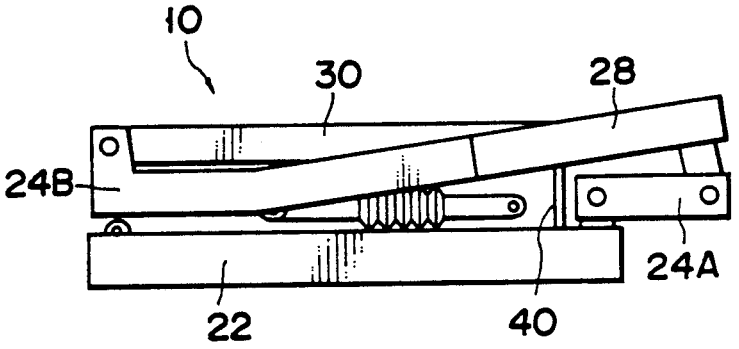

If the excessive length of jack 26 makes the above manner of folding support assembly 10 difficult, one end thereof is removed from base 22 as shown in FIG. 8, and jack 26 is turned in a direction of arrow D in FIG. 8. Now, support assembly 10 may be folded in the manner shown in FIG. 9. When using the apparatus, support assembly 10 may be readily assembled in a converse manner to that described above.

Reflector 12 in this embodiment, as shown in FIG. 1, consists of two, substantially symmetrical parts 12A, 12B. These parts are assembled together by mounting screws. Therefore, when antenna apparatus 2 is to be transported, reflector 12 can be disassembled and compactly accommodated.

Now, a method of assembling and installing the portable parabolic antenna apparatus according to the invention will be described with reference to FIGS. 10 to 15.

Figure 10:
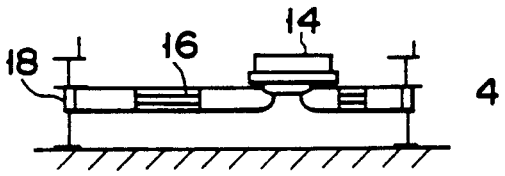
FIGS. 10 to 15 are perspective views showing a method of assembling a portable parabola antenna apparatus according to the invention.
Figure 11:
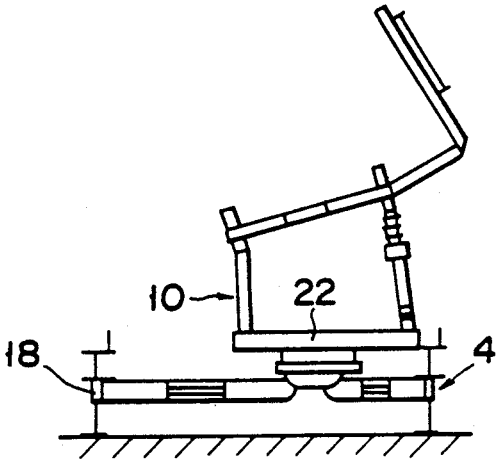
Figure 12:
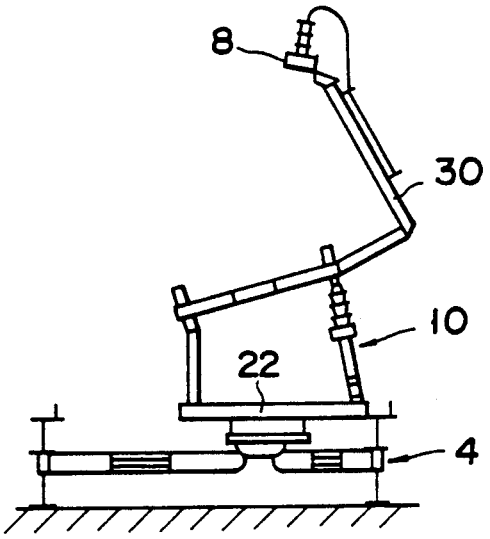
Figure 13:
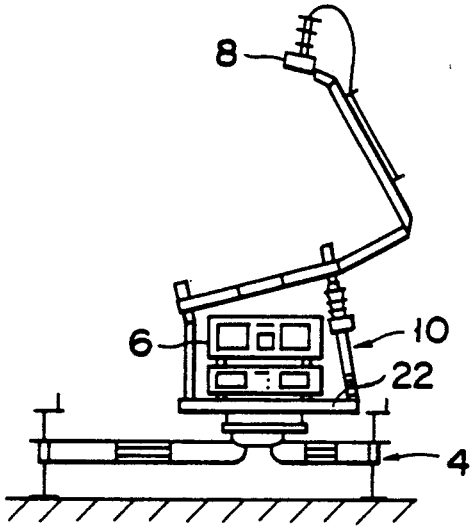
Figure 14:
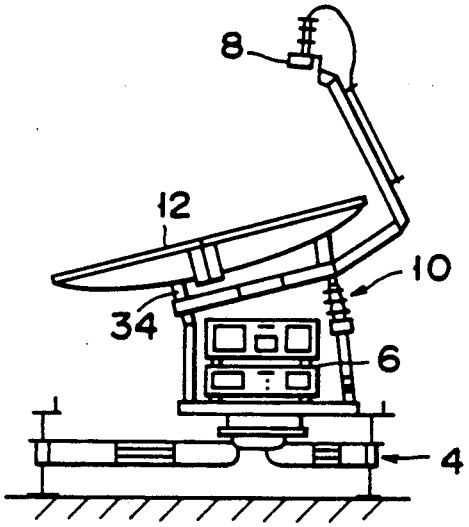
Figure 15:
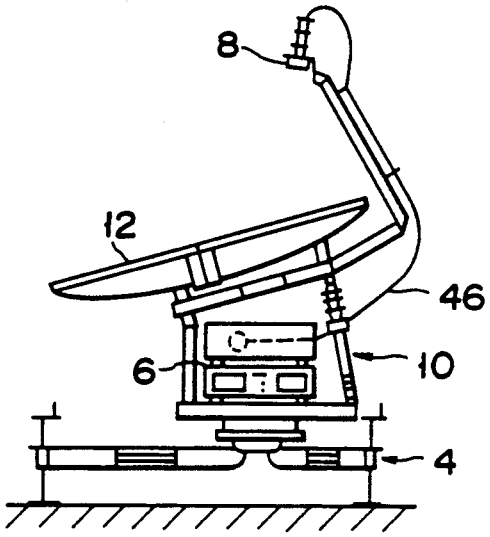

First, as shown in FIG. 10, tripod 14 is spread and installed at a given place. Then, as shown in FIG. 11, support assembly 10 is unfolded, and its base 22 is mounted on platform 14 of tripod 4. Thereafter, support assembly 10 is adjusted to a substantially horizontal position by operating jack 18. Then, as shown in FIG. 12, primary radiator 8 is mounted on the free end of arm 30 of support assembly 10. Subsequently, communication device 6 is mounted on base 22 of support assembly 10 as shown in FIG. 13. Then, as shown in FIG. 14, reflector 12 is assembled and mounted on projected portions 34 of support assembly 10. Finally, primary radiator 8 and communication device 6 are electrically connected to each other by waveguide or cable 46 as shown in FIG. 15. After the above operations have been completed, the orientations of support assembly 10 and reflector 12 are finely adjusted to linkup with a satellite, and then further polarization-adjusting is carried out.

As has been shown, with the portable antenna apparatus, tripod 4, primary radiator 8, support assembly 10, and reflector 12 can be transported separately. Also, tripod 4, support assembly 10, and disassemble reflector 12 can be folded into parts, so that these components can be conveniently carried. Thus, the antenna apparatus can be very readily carried. Further, by forming the tripod, reflector support assembly, etc. as respective aluminum die-casting, it is possible to provide an antenna apparatus, which is lighter in weight and has an excellent portability.

Particularly, according to the invention, communication device 6 is accommodated in support assembly 10, so that it is possible to greatly reduce the distance between communication device 6 and primary radiator 8. This reduction of distance between communication device 6 and primary radiator 8 is very effective for satellite communication which utilizes microwaves. Further, in the antenna apparatus, coupling portions of individual components are assembled by using bolts with handles, so that the apparatus can be quickly assembled or accommodated without requiring that any particular tool be used.

Further, with the portable antenna apparatus according to the invention, it is possible to use a tetrapod in lieu of the tripod, and it is also possible to modify the structure in which the support assembly is folded.

Now, a modification of the reflector of the portable parabolic antenna apparatus according to the invention will be described with reference to FIGS. 16 to 18.

Figure 16:
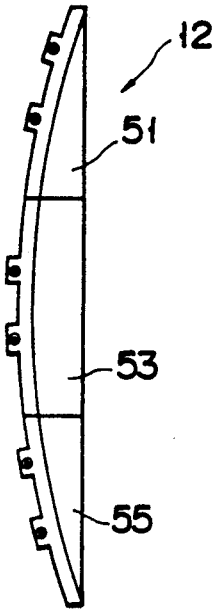
FIGS. 16 and 17 are a side view and a front view showing a modification of the parabolic reflector.
Figure 17:
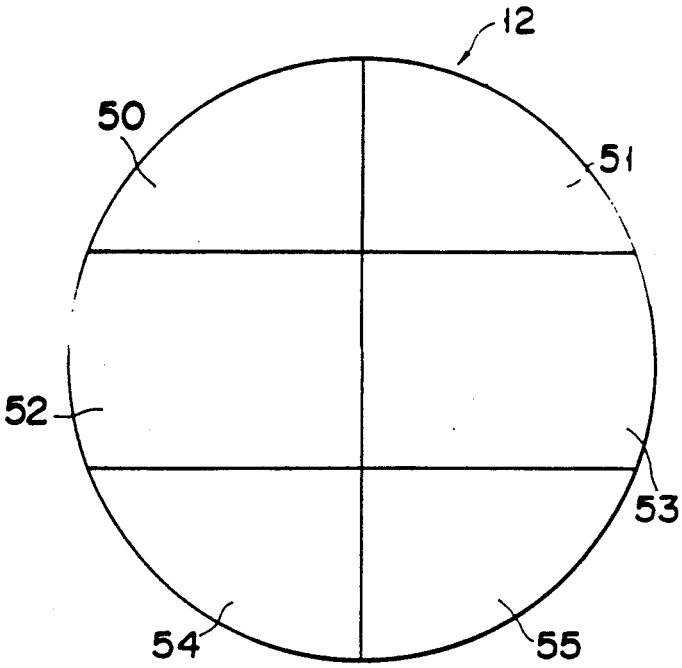

As shown in FIGS. 16 and 17, reflector 12 has six parts 50 to 55 which are made of a material having a relatively low rigidity, e.g., fiber-reinforced plastics (FRP).

Since, in this modification, parts 50 to 55 are all provided with the same coupling structure, only the structure of coupling of parts 50 and 51 will be explained with reference to FIG. 18.

Figure 18:
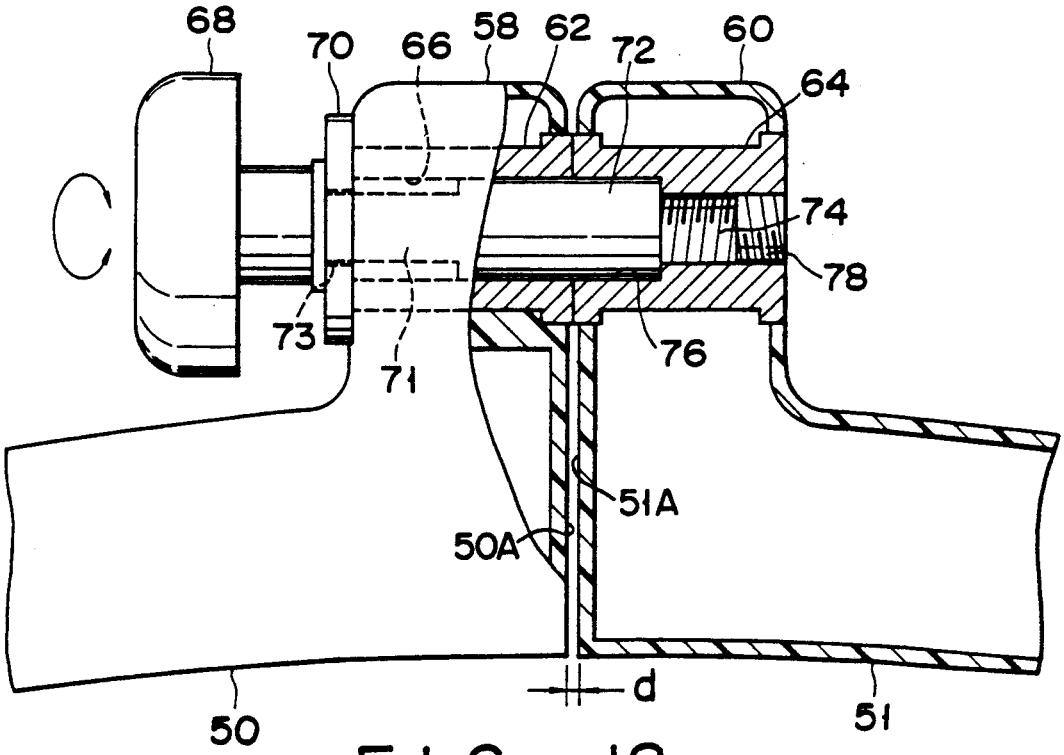
FIG. 18 is a fragmentary sectional view showing a coupling section of the parabolic reflector.

As shown in FIG. 18, opposing side surfaces 50A, 51A of parts 50 and 51 in a coupling section are provided with flanges 58 and 60 which are integral with parts 50 and 51. In flanges 58 and 60, first and second coupling members 62 and 64 being made of a metal, e.g., aluminum, are mounted. The opposed coupling surfaces of coupling members 62 and 64 slightly project from side surfaces 50A, 51A of flanges 58 and 60 of parts 50 and 51 i.e., (d/2) in this modification.

First coupling member 62 has a through bore 66 for positioning parts 50 and 51. Deformed bolt 68 is inserted into bore 66, and a handle is formed at one end thereof. When the handle is rotated to turn bolt 68, parts 50 and 51 are positioned and coupled to each other. Bolt 68 has thin portion 71 and positioning portion 72, both forming the intermediate portion of bolt 68. Thin portion 71 has a diameter which is smaller than that of positioning portion 72. Head portion 70 of first coupling member 62 has through hole 73 having a diameter which is greater than that of thin portion 71 and smaller than that of coupling portion 72. Thin portion 71 of bolt 68 is inserted in hole 73. Therefore, although parts 50 and 51 remain separated from one another, deformed bolt 68 is prevented from slipping out of first coupling member 62. Deformed bolt 68 also has an end portion 74 having a relatively small diameter and formed with a male thread. Second coupling member 64 has a bore 76 extending from the coupling surface to an intermediate position and a female thread portion 78 extending from the other end of bore 76 to the other side surface of coupling member 64 and concentric with bore 76. When parts 50 and 51 are joined together in a predetermined position, bores 66 and 76 of first and second coupling members 62 and 64 are coaxially held together by screwing deformed bolt 68.

When coupling a plurality of parts 50 to 55 together as shown in FIGS. 16 and 17, first and second coupling members 62 and 64 of parts 50 and 51 are brought into contact with each other, and then male thread portion 74 of deformed bolt 68 inserted in bore 66 of first coupling member 62 is screwed into female thread portion 78 of second coupling member 64 to a predetermined position. Thus, in a state wherein the coupling surfaces of first and second coupling members 62 and 64 are in contact with each other, the mutual positions of parts 50 and 51 can be determined by the positioning portion 72 of deformed bolt 68 in cooperation with bores 66 and 76 of first and second coupling members 62 and 64. At this time, a predetermined distance (d) is formed between the opposing side surfaces of parts 50 and 51.

Then, the other parts are, likewise, coupled to one another. Parts 50 to 55 are also sequentially coupled together in this way, so that parabolic reflector 12 is thus assembled.

In this modification of reflector 12, when coupling parts 50 to 55 together, only the coupling members (62, 64) which slightly project from the opposed side surfaces (50A, 51A) of the adjoining ones of these parts 50 to 55 are brought into contact with one another. Therefore, the stress produced by tightening the bolts which couple parts 50 to 55 together, acts only on the coupling members and has no effect on the side surfaces (50A, 51A) of parts 50 to 55. Therefore, in most or all of coupled parts 50 to 55 no strain is received, and it is possible to reliably maintain a high reflecting performance due to the lack of strain upon these coupled parts. Further, by accurately machining only the coupling surfaces of the coupling members, it is possible to maintain a highly reflective reflector surface in the assembled state. Further, since there is no possibility of straining in the individual parts during the assembling operation, it is possible to simplify the assembling operation.

In the above modification of a reflector, the adjoining parts are spaced a predetermined distance (d) apart by the coupling members when parts 50 to 55 are being coupled together. However, this is by no means limitative, and the adjoining parts may be coupled together with their opposing surfaces spaced an infinitely small distance apart, so long as the bolt-tightening force acts on the coupling surfaces of the two coupling members. In this case, the same advantages can be obtained as in the high reflecting performance.

Further, while in the above modification of a reflector, a deformed bolt and a deformed nut have been used as means for coupling together the adjoining ones of parts 50 to 55, this is again by no means limitative, and it is possible to use other means, e.g., a can mechanism, as well.

Still further, while in the above modification, the adjoining coupling members both project from the opposing side surfaces of the adjoining parts, it is also possible for only one of the coupling members to project from the side surface of the associated part, and the other coupling member to be provided such that it is found on the inner portion of the side surface of the associated part.

The embodiment and modifications described above according to the invention are by no means limitative, and various changes and modifications may be made therein without departing from the scope of the invention.

What is claimed is:

1. A portable parabolic antenna apparatus having a parabolic reflector and a communication device, comprising:

(a) a leg assembly which includes at least three foldable legs and a rotatable platform; and (b) a foldable support assembly including:

a base member mounted on the platform of the leg assembly and having a support surface for supporting the communicating device;

foldable intermediate members each having an upper end portion and a lower end portion pivotally mounted on the base member; and a reflector holding member for holding the parabolic reflector pivotally coupled to the upper end portions of the intermediate members, to allow the reflector holding member to be located at a distance from the support surface of the base, such that the communication device can be stored between the support surface and the reflector holding member when the support assembly is deployed.

2. The portable parabolic antenna apparatus according to claim 1, wherein said parabolic reflector includes:

a plurality of parts for forming said parabolic reflector; and coupling means for coupling said parts, provided at each of said parts, and having coupling members for receiving forces which are generated when said parts are coupled to one another, each coupling member being slightly projecting from a surface of each of said parts, to eliminate strains from said parts.

3. The portable parabolic antenna apparatus according to claim 2, wherein said coupling means has a bolt with a handle.

4. The portable parabolic antenna apparatus according to claim 3, wherein:

said coupling means has a through bore, and said bolt has a cylindrical positioning portion, thereby said parts being positioned to one another when the positioning portion of the bolt is inserted in the bore of the member.

5. The portable parabolic antenna apparatus according to claim 1, wherein:

said support assembly further includes an arm having a distal end portion and a proximal end portion pivotally coupled to one end of said reflector holding member and held at a predetermined angle with respect to said reflector holding member when said support assembly is deployed, and moved to be in contact with said reflector holding member when said support assembly is folded.

6. The portable parabolic antenna apparatus according to claim 5, further comprising:

a primary radiator mounted on the distal end portion of the arm of said support assembly and electrically connecting with said communication device.

7. The portable parabolic antenna apparatus according to claim 1, wherein:

each leg of said leg assembly is provided with jack means for adjusting the angle at which the support surface of said base member is inclined to the ground.

8. The portable parabolic antenna apparatus according to claim 1, wherein:

at least one of said legs in said leg assembly is provided with length adjustment means for adjusting the length of said leg.

9. The portable parabolic antenna apparatus according to claim 1, wherein:

at least one of said intermediate members having angle adjustment means for adjusting the angle at which said reflector holding member is inclined to said base member.

10. The portable parabolic antenna apparatus according to claim 1, wherein:

said leg assembly and said base of said support assembly are coupled to one another by fastening means.

11. A parabolic reflector installation apparatus associated with a parabolic reflector and a communication device, comprising:

(a) a leg assembly which includes at least three foldable legs and a rotatable platform; and (b) a foldable support assembly including:

a base member mounted on the platform of the leg assembly and having a support surface for supporting the communication device;

foldable intermediate members, each having an upper end portion and a lower end portion pivotally mounted on the base member; and a reflector holding member for holding the parabolic reflector pivotally coupled to the upper end portions of the intermediate members, to allow the reflector holding member to be located at a distance from the support surface of the base, such that the communication device can be stored between the support surface and the reflector holding member when the support assembly is deployed.

12. The parabolic reflector installation apparatus according to claim 11, wherein:

each leg of said leg assembly is provided with jack means for adjusting the angle at which the support surface of said base member is inclined to the ground.

13. The parabolic reflector installation apparatus according to claim 11, wherein:

at least one of said legs of said leg assembly is provided with length adjustment means for adjusting the length of said leg.

14. The parabolic reflector installation apparatus according to claim 11, wherein:

at least one of said intermediate members having angle adjustment means for adjusting the angle at which said reflector holding member is inclined to said base member.

15. The parabolic reflector installation apparatus according to claim 11, further comprising:

an arm having a distal end portion and a proximal end portion pivotally coupled to one end of said reflector holding member and held at a predetermined angle with respect to said reflector holding member when said support assembly is folded.

16. The parabolic reflector installation apparatus according to claim 11, wherein:

said leg assembly and said base of said support assembly are coupled to one another by fastening means.

17. A portable parabolic antenna apparatus having a parabolic reflector and a communication device, comprising:

(a) a leg assembly which includes at least three legs and a rotatable platform; and (b) a support assembly including:

a base member mounted on the platform of the leg assembly and having a support surface for supporting the communication device;

intermediate members, each having an upper end portion and a lower end portion mounted on the base member; and a reflector holding member for holding the parabolic reflector coupled to the upper end portions of the intermediate members, to allow the reflector holding member to be located at a distance from the support surface of the base, such that the communication device can be stored between the support surface and the reflector holding member.

18. A portable parabolic antenna apparatus having a parabolic reflector and a communication device comprising:

an adjustable tripod;

a platform;

mounting means for mounting said platform on said adjustable tripod and for allowing said platform to rotate on said adjustable tripod;

a base member mounted on the platform and having a support surface for supporting the communication device;

foldable intermediate members, each having an upper end portion and a lower end portion pivotally mounted on the base member; and adjustable holding means for holding the parabolic reflector pivotally coupled to the upper end portions of the intermediate members to allow the reflector holding means to be located at a distance from the support surface of the base such that the communication device can be stored between the support surface and the reflector holding means;

a primary radiator supported by said adjustable holding means; and connecting means for connecting said communication device to said primary radiator.

19: A parabolic reflector comprising:

a plurality of parts having reflecting surfaces for forming said parabolic reflector;

edge portions provided on each of said parts and having side features which are opposed to one another when said parts are coupled to one another;

bush means, being embedded in each of said edge portions, so that forces which are generated when said parts are coupled together are applied only to the bush means of the parts so coupled, and so that the received forces are not transmitted from the bush means to the reflecting surfaces due to the arrangement of said bush means in said edge portions; and connecting means for connecting the bush means of each edge portion to a bush means of an adjoining edge portion.

20. The parabolic reflector according to claim 19, wherein:

each of said bush means is made of a material having a rigidity higher than that of said parts.

21. The parabolic reflector according to claim 19, wherein:

each of said bush means slightly projects from each of the side surfaces of said edge portions.

22. The parabolic reflector according to claim 19, wherein:

each of said bush means has a through bore; and each of said connecting means has a bolt which has a cylindrical positioning portion for positioning said parts to one another when the positioning portion of the bolt is inserted in the bore of said bush means.

* * * * *